United States Patent [19]

Morsbach

[11] Patent Number: 4,744,507

[45] Date of Patent: May 17, 1988

[54] PACKAGING MATERIAL BLANK OF CARDBOARD OR THE LIKE FOR A MULTIPACK PACKAGE

[76] Inventor: Günter Morsbach, Neuendettelsauer Str. 34, 8500 Nürnberg 60, Fed. Rep. of Germany

[21] Appl. No.: 831,275

[22] Filed: Feb. 20, 1986

[30] Foreign Application Priority Data

Feb. 20, 1985 [DE] Fed. Rep. of Germany ..... 3505806

[51] Int. Cl.[4] ..... B65D 5/08

[52] U.S. Cl. ..... 229/40; 206/427; 229/134; 229/137

[58] Field of Search ..... 229/40, 132, 136, 137, 229/138, 155, 158, 134; 206/427, 434, 140

[56] References Cited

U.S. PATENT DOCUMENTS

| | | | |
|---|---|---|---|
| 3,042,194 | 7/1962 | Champlin | 206/427 |
| 3,904,036 | 9/1975 | Forrer | 229/40 |
| 3,934,791 | 1/1976 | Dick et al. | 229/132 |
| 4,440,340 | 4/1984 | Bakx | 229/40 |
| 4,482,090 | 11/1984 | Milliens | 229/40 |

FOREIGN PATENT DOCUMENTS

| | | | |
|---|---|---|---|
| 2320190 | 11/1973 | Fed. Rep. of Germany | 229/28 BC |
| 2933613 | 3/1980 | Fed. Rep. of Germany | 229/28 BC |

*Primary Examiner*—Stephen Marcus
*Assistant Examiner*—Gary E. Elkins
*Attorney, Agent, or Firm*—Browdy and Neimark

[57] ABSTRACT

In a blank of cardboard packaging material for a multipack type of package for containers, in particular bottles, having an upper part with laterally bendable oblique panels provided as a transition to the side panels, which continue to form a bottom panel and provided with from and back closure flaps for equalizing tolerances in the containers that are to be enveloped, bottom flaps joined to the bottom part with bending lines are provided, with bottom flaps disposed thereon that can be folded in via bending lines and that are joined via bending lines to lower and middle side panels. Cover flaps are joined to a cover part via bending lines, and side flaps that have perforated tolerance-equalizing bending lines are joined to oblique panels in a bendable manner by means of bending lines.

4 Claims, 2 Drawing Sheets

FIG. 2
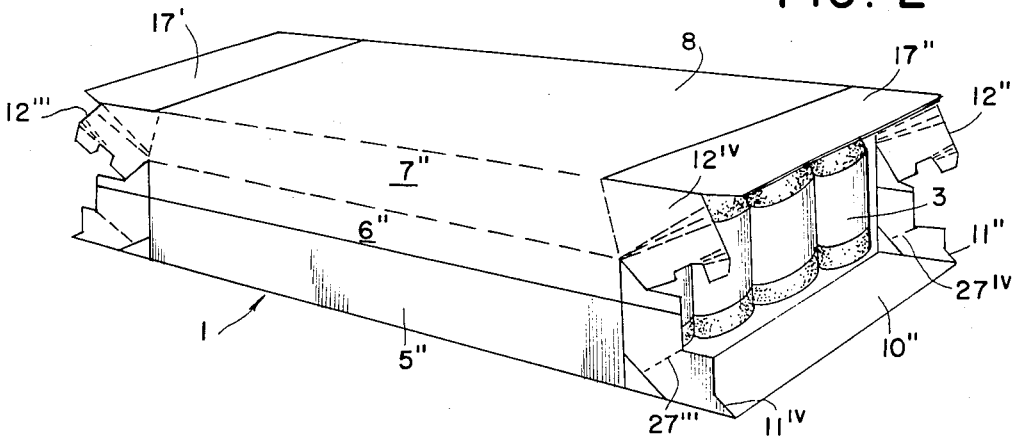
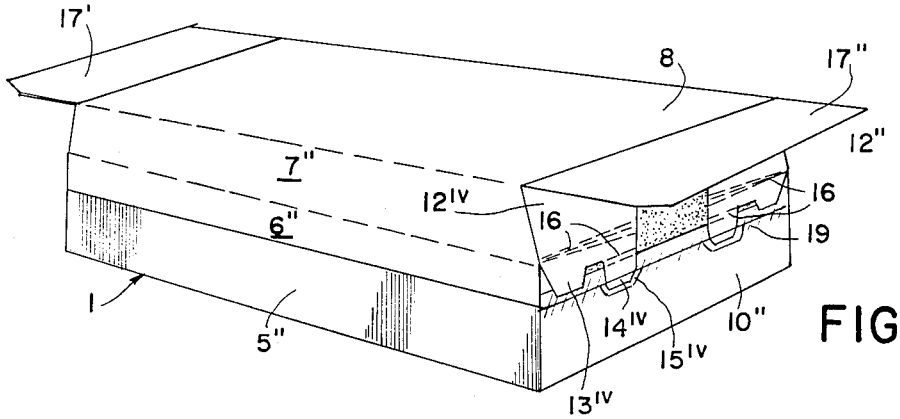
FIG. 3
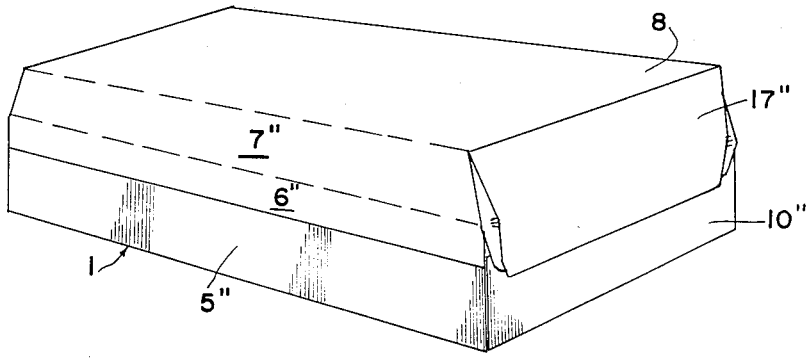
FIG. 4

PACKAGING MATERIAL BLANK OF CARDBOARD OR THE LIKE FOR A MULTIPACK PACKAGE

FIELD OF THE INVENTION

The present invention relates to a blank of packaging material made of cardboard or the like for a multipack type of package for containers, in particular bottles. The package has an upper part with oblique panels that can be bent down laterally to make a transition to the side panels, which continue to form a bottom part, and has front and back closure flaps.

BACKGROUND OF THE INVENTION

Packaging material blanks for multipacks intended for bottles, cans or other containers are known. Typically, the individual containers are held firmly on the edges or outsides by a package blank, which surrounds the containers with a covering surface at the top and with side parts on the sides of the containers and is joined to a bottom part. In such packages, to protect or secure the contents against sliding or falling out, the packaging material blank, or package, should have front and end parts, or side parts, that can be folded or glued. Packaging material blanks of this type are known, for instance from European Pat. No. 0 044 169, French patent application No. 22 91 112, and European Pat. No. 0 042 711. Because of the variety of types of packaging material blanks, which typically have a certain rigid, invariable cross section defined by the various folding or cohering parts and by the gluing tabs, tearing of the package or packaging tube can occur when the product is introduced into such packages, because of differences in tolerances or dimensions, especially in bottle heights, or else the localized strain where the blank is glued can cause the package to burst at those points.

To assure the most problem-free introduction of the product into the package, especially in packages having several rows of bottles of different heights disposed side by side, and thus to assure problem-free operation of packaging plants as much as possible, there is a need for flexible packages that can be adapted to the product they will contain.

Previously, a package surrounding containers on all sides could be attained only with packages, or packaging material blanks, of which the dimensions, i.e. the cross section that was required, that were arranged for the maximum tolerances of the product in the package, especially in terms of the height of the product. As a result, additional provisions had to be made to protect the containers from colliding with one another or slipping. This sometimes necessitates special selection of the product to be packaged, such as bottles. This is extremely uneconomical, and all the more so when such packages are disposable, single-use packages.

SUMMARY OF THE INVENTION

It is accordingly a principal object of the invention to devise a packaging material blank for multipack use, for enveloping a product, in particular bottles arranged in multiple rows, which makes it possible to compensate for tolerances of the containers, surrounds the containers on all sides, is simple to manufacture and handle, and enables problem-free operation and package filling using packaging machines.

In a packaging material blank of the above general type, this object is attained substantially by providing that the blank has bottom flaps, joined to the bottom part with bending lines, having bottom flaps with fold lines that can be folded in at the side and joined via bending lines with lower and middle side panels; cover flaps are joined via bending lines to a cover part, and side flaps having perforated, tolerance-equalizing bending lines are bendably joined by means of bending lines to oblique panels.

A packaging material blank embodied according to the invention makes it possible to manufacture packages in suitable packaging machines, such that for instance with bottles a full equalization of tolerances is possible, in particular in terms of height and diameter of the bottles, and such that the containers are tightly surrounded on all six sides, resulting in a closed package that by its flexibility compensates for the varying bottle heights, especially when the end portions of the package are closed.

According to an advantageous feature of the invention, indentations are stamped into the bottom flaps to receive tabs embodied on the side flaps.

In another advantageous feature of the invention, the bottom part and the bottom flaps have adhesive strips on the side, which are provided with a strip of glue and are joined via bending lines.

A further advantage is that the bottom flaps that can be folded on the side can be folded in on both the fold lines and the bending lines, after the product has been introduced into the package, such that the bottom flaps, which are joined to the bottom part via the bending lines, can be set upright.

Still another advantage is that the cover part is joined to the oblique panels as well as with the middle side panels via bending lines in such a manner that by laterally shifting the center axes of the cover part relative to the bottom part, a variable spacing in height on a particular side is attainable, and that after folding in or bending down of the side flaps for equalizing tolerances, tabs formed on the side flaps engage stamped indentations in the bottom flaps, thereby bending down the side flaps in a form-fitting manner at the perforated tolerance-equalizing bending lines, in accordance with the position of the side flaps relative to the bottom flaps and to the product.

Yet another advantage of the invention is that a recess is provided in the cover part for a handle, and a perforation is provided on one of the side panels for opening the package.

The invention will now be described in detail in terms of an advantageous exemplary embodiment, referring to the drawings.

BRIEF DESCRIPTION OF THE DRAWINGS

FIG. 2 shows a multipack made from a blank as shown in FIG. 1, with the product having been introduced into the package;

FIG. 3 shows the package of FIG. 2, in a partially closed state; and

FIG. 4 shows the closed package.

DESCRIPTION OF THE PREFERRED EMBODIMENT

Figure 1:
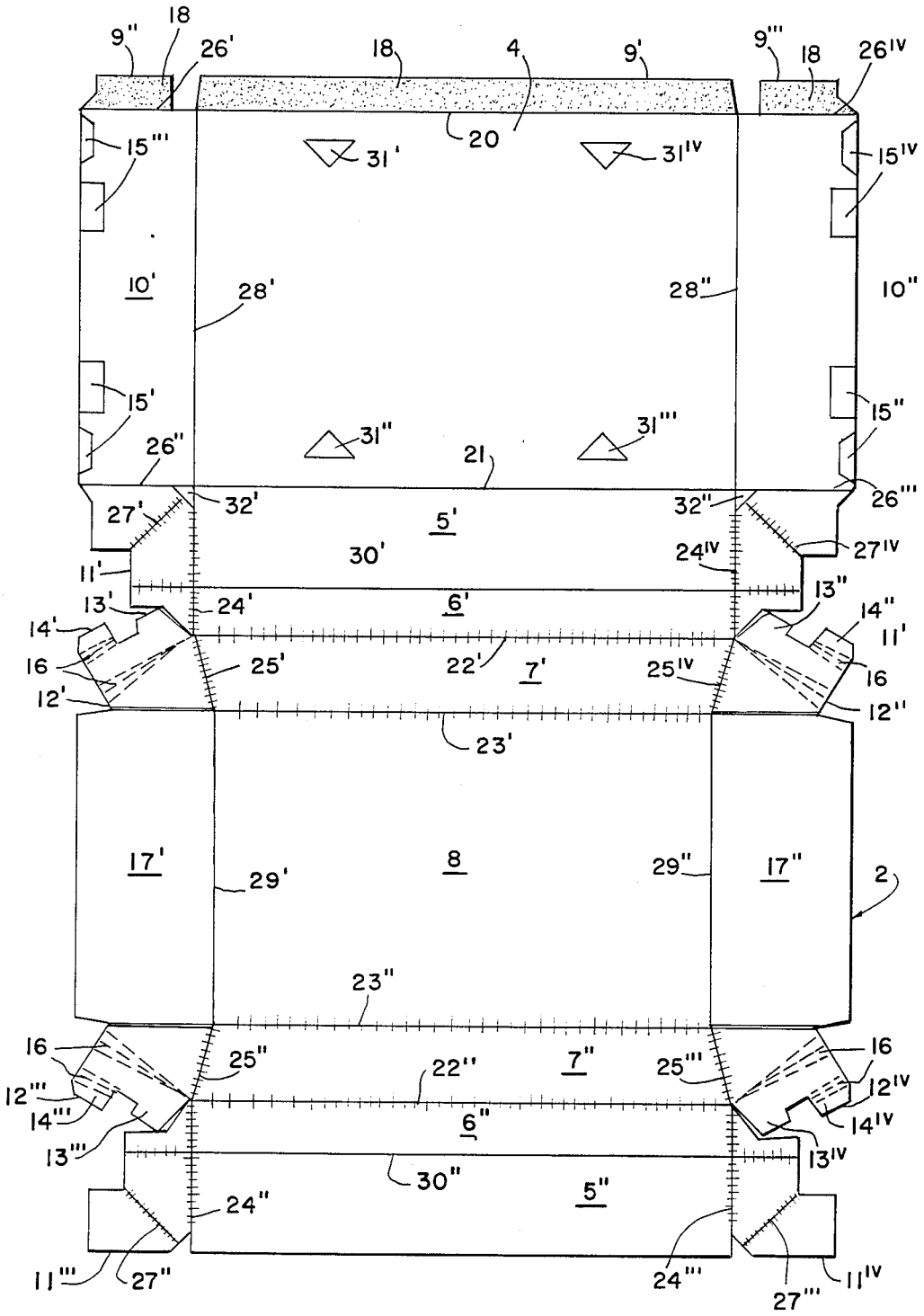
FIG. 1 shows a packaging material blank according to the invention.

A packaging material blank 2 according to the invention, preferably made of cardboard, has a bottom part 4, in which stamped cutouts 31'—31'$^{v}$ have been provided. Openings by which the package can be grasped can also be stamped out of the cover part 8, but these are not shown here.

Adhesive tabs 9'', 9' and 9''', which are provided with a glue strip 18, are disposed on the bottom part 4 and the bottom flaps 10', 10''. Once the lower side panel 5'' is joined to the side adhesive strips 9'-9''', a tubular object is formed. The bottom part 4 has bottom flaps 10' and 10'' which can be bent downward via the bending lines 28' and 28'' and are provided with indentations 15 for receiving the adhesive tabs 13'—13'$^{v}$ and 14'—14'$^{v}$, respectively. On the long sides, side panels 5' and 5'' and 6' and 6'' are provided, which can be bent down via the bending lines 20 and 21 and which have side bottom flaps 11'—11'$^{v}$ that can be bent down or folded in on the bending lines 24'—24'$^{v}$ and 26'—26'$^{v}$, respectively. At the intersection of the bending lines 26'' and 24' and of the bending lines 26''' and 24'$^{v}$, respective stamped cutouts 32' and 32'' are provided.

The lower side panels 5', 5'' are joined via bending lines 30' and 30'' to upper side panels 6' and 6'', which are joined in turn via bending lines 22', 22' to oblique panels 7', 7'' and then to the cover part 8. Side flaps for equalizing tolerance, 12'—12'$^{v}$, are disposed on the oblique panels 7' and 7'' and can be bent down via bending lines 25'—25'$^{v}$. These side flaps 12'—12'$^{v}$ have perforated tolerance-equalizing bending lines, so that once the package is closed, the side flaps optimally adapt to the product in the package in accordance with where they are located. The side flaps 12'—12'$^{v}$ are each embodied on one side in the form of respective tabs 13'—13'$^{v}$ and 14'—14'$^{v}$. These tabs 13'—13'$^{v}$ and 14'—14'$^{v}$, after closure of the package, engage corresponding stamped indentations 15'—15'$^{v}$ of the bottom flaps 10', 10'' and thus provide a smooth surface to which the cover flaps 17', 17'' can be glued.

FIG. 2 shows a package 1 comprising the packaging material blank 2, which is firmly joined together into a tubular article by gluing the side adhesive strip 9'-9'' to the lower side part 5'', or the lower bottom flaps 11'' and 11'$^{v}$. As shown in FIG. 2, the product 3 is introduced into this cardboard tube in the form of bottles disposed in four rows one beside the other. The cardboard tube, which is flexible by way of the bending lines 20, 21, 23', 23'', 22' and 22'', and 30' and 30'', is optimally capable of adapting to the external form of the bottles or product 3 as well as to the height thereof, which is sometimes variable because of the tolerances of the bottles. Once the product has been inserted into the cardboard tube in a packaging machine, appropriate gripping and folding devices fold or pull the foldable side bottom flaps inward in such a way that the bottom flaps 10', 10'' rest against the product 3 or bottles 3.

Next, the side flaps for equalizing tolerance, 12'—12'$^{v}$, are bent inward, so that they become deformed, at the perforated tolerance-equalizing bending lines 16, in an optimal position with respect to the bottom flap and thus adapt to the product. The tabs 13'—13'$^{v}$ and 14'—14'$^{v}$ formed on the side flaps 12'—12'$^{v}$ are thereby inserted, flush with the surface, into the stamped indentations 15'—15'$^{v}$ provided in the bottom flaps 10', 10''.

Finally, as shown in FIG. 4, the cover flaps 17', 17'' are bent downward, such that, via an adhesive strip 19 as shown in FIG. 3, they can be glued to the bottom flaps 10' and 10'' and to the lateral tolerance-equalizing flaps 12'—12'$^{v}$.

As explained, the package according to the invention provides a firm enclosure around the containers that are to be packed and which differ in height within a certain range of tolerance, and enables an optimal equalization of tolerance, so that when the product, or bottles, are introduced into the cardboard tube, tearing or bursting of the tube is prevented. The arrangement of the bottom flaps that can be folded in at the sides, and of the bottom flaps, and also of the side flaps intended for equalizing tolerance via their bending lines, enables strain-free closure of the package itself even though the height of the product or bottles may vary. Because the containers are surrounded on all sides, light, which might damage the product, is also completely prevented from entering the package.

The invention is not restricted merely to the exemplary embodiments shown and described herein. A different number of containers or rows of containers may also be provided, for instance in a single-, double- or multiple-row arrangement, all that is needed is a change in the lengthwise dimensions of the packaging material blank 2. It is also possible for the blank 2 to be made with appropriate cutouts for a carrying handle strip, or with recesses for use in carrying the package.

Thus the invention encompasses any modifications and variations within the competence of one skilled in the art, as well as partial and subcombinations of the features and characteristics shown and/or described herein.

What is claimed is:

1. A packaging material blank for a multipack package comprising an upper part including a cover part, cover flaps connected by bending lines to opposite lateral sides of said cover part;

oblique panels connected by bending lines to opposite longitudinal sides of said cover part;

side panels connected by bending lines to each of said oblique panels on longitudinal sides opposite from the connection of said oblique panels to said cover part;

said side panels including upper and lower side panels connected to each other by bending lines;

a bottom part connected by a bending line to at least one of said side panels along a longitudinal side opposite from the connection of said side panel to said oblique panel;

side flaps connected on opposite lateral edges of said oblique panels and having perforated bending lines on said side flaps oriented to function for tolerance equalizing;

first bottom flaps connected by bending lines on opposite lateral edges of said bottom part;

second bottom flaps connected by bending lines on opposite lateral edges of said lower side panels;

said side flaps have side tabs extending therefrom;

said first bottom flaps have stamped indentations therein;

side tabs and indentations being oriented to allow said stamped indentations to receive said side tabs when said cover and bottom parts are in substantially parallel planes whereby a smooth surface is presented to said cover flaps when folded to overlie said first bottom flaps.

2. The blank of claim 1 wherein oblique bending lines which are oblique relative to said bending lines along lateral edges of said cover part connect said side flaps to said oblique panels.

3. The blank of claim 1 further including adhesive tabs extending laterally from and connected to said bottom part by a bending line and to each of said first bottom flaps by a bending line respectively;

a glue strip provided on said adhesive tabs.

4. The blank of claim 1 further including at least one cutout in said bottom part.

* * * * *